US005981463A

United States Patent [19]

Oberlander et al.

[11] Patent Number: 5,981,463

[45] Date of Patent: Nov. 9, 1999

[54] ANHYDROUS DETERGENT/BLEACH COMPOSITION AND METHOD OF PREPARING SAME

[75] Inventors: Michael Oberlander, Kansas City; Robert P. Langguth, Overland, both of Mo.

[73] Assignee: Noramtech Corporation, Kansas City, Mo.

[21] Appl. No.: 09/093,211

[22] Filed: Jun. 8, 1998

[51] Int. Cl.[6] ..... C11D 3/395; C11D 3/48; C11D 17/00

[52] U.S. Cl. ..... 510/445; 510/224; 510/367

[58] Field of Search ..... 510/441, 224, 510/445, 446, 367, 375

[56] References Cited

U.S. PATENT DOCUMENTS

| | | | |
|---|---|---|---|
| Re. 32,763 | 10/1988 | Fernholtz et al. | 252/90 |
| Re. 32,818 | 1/1989 | Fernholtz et al. | 252/90 |
| 3,441,507 | 4/1969 | Schiefer et al. | 252/95 |
| 3,925,234 | 12/1975 | Hachmann et al. | 252/186 |
| 4,009,113 | 2/1977 | Green et al. | 252/95 |
| 4,087,369 | 5/1978 | Wevers | 252/102 |
| 4,124,734 | 11/1978 | Alterman et al. | 428/403 |
| 4,126,573 | 11/1978 | Johnston | 252/99 |
| 4,399,049 | 8/1983 | Gray et al. | 252/91 |
| 4,444,674 | 4/1984 | Gray et al. | 252/95 |
| 4,595,520 | 6/1986 | Heile et al. | 252/160 |
| 4,678,594 | 7/1987 | Parfomak et al. | 252/186.31 |
| 4,680,134 | 7/1987 | Heile et al. | 252/160 |
| 5,055,217 | 10/1991 | Garcia et al. | 252/94 |
| 5,112,514 | 5/1992 | Bolkan et al. | 252/99 |
| 5,739,095 | 4/1998 | Langguth et al. . | |
| 5,759,988 | 6/1998 | Heile et al. | 510/441 |
| 5,830,839 | 11/1998 | Scepanski | 510/305 |

*Primary Examiner*—Yogendra Gupta
*Assistant Examiner*—John M Petruncio
*Attorney, Agent, or Firm*—Hovey, Williams, Timmons & Collins

[57] ABSTRACT

A solid, essentially anhydrous peroxygen bleaching and sanitizing composition which includes a peroxygen bleaching agent, an activator capable of forming a per-acid in the presence of oxygen, and an essentially anhydrous, non-reactive binding agent. The composition of this invention is stable in high humidity and cleans and sanitizes effectively in warm water as well as in hot water. The binding agent utilized in this invention is essentially anhydrous and non-reactive with oxygen. The melting point of the binding agent is preferably from about 35–85° C., more preferably from about 45–70° C., and most preferably from about 50–60° C. The binding agent is present in the composition at a level of from about 25–65%, preferably from about 30–55%, and more preferably from about 35–45% by weight. In addition to these ingredients, optional functional ingredients can be utilized as necessary for specific cleaning purposes.

14 Claims, No Drawings

ANHYDROUS DETERGENT/BLEACH COMPOSITION AND METHOD OF PREPARING SAME

FIELD OF THE INVENTION

This invention broadly relates to a solid, essentially homogenous, anhydrous detergent/bleaching composition containing normally reactive ingredients and a method for preparing such solid bodies. More particularly the solid detergent/bleaching bodies of the invention include a peroxygen bleaching agent, an oxygen bleach activator reactive with the peroxygen beaching agent in solution, and a non-reactive binding agent which does not form reactive hydrates in the solid compositions. The solid detergent/bleaching compositions hereof may be used for warewash, laundry, or general hard surface cleaning.

DESCRIPTION OF THE PRIOR ART

Bleaching agents have been widely used as an adjunct to detergents for household and industrial dishwashing, laundering, and general hard surface cleaning applications, because of the improved cleaning results that are directly attributable to the use of bleaching compositions. There are two major classes of bleaching agents commonly employed in existing detergent compositions—chlorine-based and oxygen-based (hereinafter referred to as peroxygen). Recently chlorine-based bleaching agents have come under adverse public scrutiny because of contaminating toxic residues which are generated by their use. Peroxygen bleaching agents, however, are essentially safe and non-toxic and do not present significant environmental hazards.

Powdered bleaching agents, either with or without a detergent, are popular with users because they are highly effective and can be packaged without the problems of spillage and container rupture associated with comparable liquid bleaching agents. Powdered peroxygen bleaching agents known in the art include sodium perborate, sodium percarbonate, and potassium monopersulfate. These bleaching agents have been used alone and have also been incorporated into certain cleaning formulations to provide an added destaining function.

In order for bleaching compositions to be effective, it is necessary for the components thereof to be uniformly distributed in the cleaning mixture. Furthermore, the effectiveness of peroxygen bleaching agents is highly dependent upon the temperature of the bleaching solution, with greatly diminished bleaching results being obtained if the temperature of the bleaching solution falls below about 60° C. This is a particular problem in many institutional settings, such as nursing homes, where the maximum allowable temperatures may be limited to about 52° C., below that required for effective bleaching.

Bleach activators have been used to improve the bleaching efficiency of peroxygen bleaching agents at lower temperatures. Powdered mixtures of peroxygen bleaching agent and activator are stable so long as none of the formulation ingredients contain water of hydration, which causes premature dissolution of the bleaching ingredients. Additionally, storage of such mixture in a laundry area of high humidity can cause premature reaction between the peroxygen bleaching agent and the activator. In order to avoid these problems, it has previously been necessary to utilize two powder formulations—one with the peroxygen bleaching agent and one with the activator—and keep them separate until the time of use when they are combined to obtain the effect of the activator in a bleaching solution.

Solid bleaching compositions are an alternative to liquid and powder products. In solid bleaching compositions, a solidifying agent is added to an aqueous mixture at elevated temperatures. Upon cooling, the solidifying agent forms hydrates which solidifies the mixture. Because solid bleaching products have a reduced surface area and are generally stored in the same mold in which they were formed, they are not subject to the premature activation of the peroxygen bleaching agent as is the case with powder compositions. However, because of the hydrates present in solid bleaching compositions, it has previously been impossible to use an activator, such as N,N,N',N', tetraacetylethylenediamine, in a solid bleaching composition. Such a product would be unstable, immediately reacting and losing valuable bleaching oxygen. Therefore, prior art solid bleaching compositions must be used at extremely high temperatures (i.e., above 60° C.) to be effective.

There is accordingly a need for essentially anhydrous and homogeneous solid bleaching and sanitizing compositions containing both a peroxygen bleaching agent and an activator which will dissolve readily in warm to hot water. Such compositions also should be resistant to loss of valuable bleaching oxygen and activator effectiveness and free of toxic residue pollutants.

SUMMARY OF THE INVENTION

The present invention overcomes these problems by providing solid essentially anhydrous bleaching and sanitizing compositions. It has been discovered that stable, essentially anhydrous slurries of a peroxygen bleaching agent and an oxygen bleaching activator dispersed in a melted non-reactive binding agent having a melting point of from about 35–85° C., will solidify into a stable homogeneous cast solid when cooled to room temperature. The solid bodies should contain less than about 1% by weight water, should not appreciably melt at temperatures below about 35° C., and should, with light agitation, substantially dissolve in cool to warm water within 2–3 minutes.

The bleaching agents used in the solid bodies are peroxygen bleaching agents which do not contain any water of hydration. Preferably, the peroxygen bleaching agents are present in the compositions at a level of from about 10–45% by weight, more preferably from about 15–35% by weight, and most preferably at a level of about 20% by weight. While any essentially anhydrous peroxygen bleaching agent is suitable for this bleaching composition, the most preferred bleaching agents are selected from the group consisting of sodium percarbonate, sodium perborate monohydrate, anhydrous sodium peroxyphosphates, and anhydrous potassium peroxyphosphates, and mixtures thereof.

Suitable activators include any compound which is capable of forming a per-acid with oxygen in solution. Preferred activators include sodium p-acetoxybenzenesulfonate, trisacetylcyanurate, acetylimidazole, benzoylimidazole, and mixtures thereof. The most preferred activator is N,N,N',N' tetraacetylethylenediamine. (TAED) The activator is preferably present in the solid products at a level of from about 3–20%, more preferably from about 5–15%, and most preferably at a level of about 7%.

The binding agent should not have any appreciable water associated with it (i.e., it must be essentially anhydrous), should be water soluble, and should not react with oxygen (i.e., it should not be oxidized or bleached). The melting point of the binding agent is preferably from about 35–85° C., more preferably from about 45–70° C., and most preferably from about 50–60° C. The binding agent is present in the composition at a level of from about 25–65%, preferably from about 30–55%, and more preferably from about 35–45% by weight based on the total weight of the ingredients used.

The preferred binding agents are nonionic organic compounds, such as nonionic surfactants, that are solid at room temperature and have a melting point range as discussed above. Preferred binding agents include ethylene oxide adducts of octyl-phenols, ethylene oxide adducts of nonyl-phenols, ethylene oxide adducts of dodecyl-phenols, primary and secondary alcohol ethoxylates, polyethylene glycol mono-stearate esters, polyethylene glycol di-stearate esters, amides, ethoxylated amides, and mixtures thereof. Preferred binding agents further include any essentially anhydrous, water soluble block copolymer that is essentially non-reactive with oxygen, such as ethylene-propylene oxide block copolymers. Some particularly preferred binding agents are Pluronic L68-LF (an ethylene-propylene oxide block copolymer made by BASF), Tergitol 15-S-30 (an ethylene oxide adduct of a secondary alcohol made by Union Carbide), and Pluracol E2000 (a polyethylene glycol made by BASF).

In addition to the peroxygen bleaching agent, activator, and binding agent, numerous functional ingredients can be added to the products hereof as desired in order to achieve various functional or performance properties necessary for a specific cleaning purpose. For example, in addition to the preferred non-reactive binding agents described above, a second surfactant can be used in amounts lesser than the amount of binding agent used. Suitable secondary surfactants are essentially anhydrous and include nonionic surfactants (such as ethylene oxide adducts), anionic surfactants (such as alkali metal alkylbenzene sulfonates, alkali metal alkyl sulfates, alkali metal α-olefin sulfonates, and mixtures thereof), and soaps.

The bleaching and sanitizing compositions of this invention may optionally include water conditioning agents such as tetrasodium pyrophosphate, sodium tripolyphosphate, trisodium nitrilotriacetate, sodium polyacrylate, and zeolites. The concentration of water conditioning agent(s) will vary depending upon the intended use of the composition. In laundry uses, for example, the level of water conditioning agent(s) in the composition should be from about 10–30% by weight.

Other functional ingredients which may be utilized with the compositions of this invention include any functional ingredient which is suitable for use in a laundry detergent, such as enzymes, soil antiredeposition agents, and fluorescent whitening agents. Preferred fluorescent whitening agents are Tinopal 5BM-GX (a cyanuric chloride/diaminostilbene disulfonic acid derivative made by Ciba-Geigy), Tinopal CBS-X (a distyrylbiphenyl derivative made by Ciba-Geigy), and Tinopal AMS-GX (a cyanuric chloride/diaminostilbene disulfonic acid derivative made by Ciba-Geigy).

In preparing the solid essentially anhydrous bleaching and sanitizing compositions of this invention, a quantity of an essentially anhydrous, non-reactive binding agent is first melted at a temperature of from about 5–40° C. above its melting point (i.e., at about 40–125° C. depending on the selected binding agent) and added to a mixing vessel. Any desired optional functional ingredients which are a liquid at room temperature are then added to the melted binding agent. The resulting mixture is stirred thoroughly. Next, the solid oxygen bleach activator is added with mixing followed by the addition of any remaining optional functional ingredients. Finally, the peroxygen bleaching agent is added to the slurry, and the resulting product is mixed thoroughly to substantial homogeneity. If any enzymes are to be added, this should be done when the temperature of the mixture is no greater than about 45° C. in order to avoid destroying the functionalities of the enzymes. The resulting composition is then preferably poured into a mold for cooling. Upon cooling, the composition will form a self-sustaining solid that is homogeneous and non-reactive until it is dissolved in water for use.

DETAILED DESCRIPTION OF THE PREFERRED EMBODIMENTS

The following examples set forth preferred methods in accordance with the invention. It is to be understood, however, that these examples are provided by way of illustration and nothing therein should be taken as a limitation upon the overall scope of the invention.

EXAMPLE 1

Preparation of a Bleaching and Sanitizing Composition

Forty-one grams of Pluronic L68-LF (block copolymer from BASF) was melted to a liquid at a temperature of about 75° C. followed by transfer to a liquid mixer equipped with a propeller agitator. Agitation was initiated and continued throughout the remainder of the preparation of the bleaching and sanitizing composition. Five grams of a liquid nonylphenol having 9–10 moles of ethylene oxide per mole of nonylphenol (Makon 10, Walsh & Associates, Kansas City, Mo.) was then added and thoroughly mixed with the melted Pluronic L68-LF. Six grams of N,N,N,N' tetraacetylethylenediamine was added and mixed, followed by the addition of 28 grams of sodium tripolyphosphate and 20 grams of sodium perborate. The homogeneous mixture was poured into a mold and allowed to harden by cooling in ambient air.

EXAMPLE 2

Preparation of a Bleaching and Sanitizing Composition

Seventy-eight grams of T-Det N-30 (Thompson-Hayward Chemical Co.) was melted to a liquid at a temperature of about 65° C. followed by transfer to a liquid mixer equipped with a propeller agitator. Agitation was initiated and continued throughout the preparation of the bleaching and sanitizing composition. Six grams of Makon 10 (see Example 1) and six grams of a nonylphenol having 3–4 moles of ethylene oxide per mole of nonylphenol (T-Det-4, Thompson-Hayward Chemical Co.) were thoroughly mixed with the melted T-Det N-30. To this mixture, 2 grams of an alkylbenzene sulfonate sodium salt was added while mixing was continued. This was followed by the addition and mixing of 1.3 grams of carboxymethylcellulose and 0.7 grams of Tinopal CBS-X (obtained from Ciba-Geigy). Fourteen grams of N,N,N',N' tetraacetylethylenediamine and 54 grams of sodium tripolyphosphate were added and mixed, followed by the addition of 36 grams of sodium percarbonate after the mixture was homogeneous. The temperature of the resultant mixture was cooled to 45° C., and 1 gram of an oxygen-stable protease enzyme (Everlase, Nova Dordisk) and 1 gram of an alkaline-stable lipase enzyme (Lipolase, Nova Dordisk) were added. The homogeneous mixture was poured into a mold and allowed to harden by cooling.

I claim:

1. A solid, essentially anhydrous bleaching, detergent and sanitizing body comprising:

a self-sustaining body having on a percent by weight basis a substantially homogeneous mixture of from about 10% to about 45% of a peroxygen bleaching agent devoid of water of hydration, from about 3% to about 20% of an oxygen bleach activator capable of reacting with the bleaching agent to form a per-acid with oxygen, from about 25% to about 65% of an essentially anhydrous, water-soluble, non-ionic surfactant binding agent that does not react with water, has a melting point within the range of about 35° C. to about 85° C. and is selected from the group consisting of ethylene oxide adducts of octyl-phenols, ethylene oxide adducts of nonyl-phenols, ethylene oxide adducts of dodecyl-phenols, and primary and secondary alcohol ethoxylates, and from about 10% to about 30% of a water-conditioning agent selected from the group consisting of sodium tripolyphosphate, tetrasodium pyrophosphate, trisodium nitrilotriacetate) sodium polyacrylate and zeolites, said body prepared by mixing together said bleaching agent, bleach activator, binding agent and water-conditioning agent at an elevated temperature to yield a substantially homogeneous molten slurry, and cooling and solidifying the molten slurry in a mold to form the body said body containing less than about 1% by weight water.

2. A solid, self-sustaining body as set forth in claim 1, said body prepared by pouring said molten slurry into a mold, and allowing the molten slurry to cool and solidify therein.

3. A solid, self-sustaining body as set forth in claim 1, wherein said melting point is from about 45° C. to about 70° C.

4. A solid, self-sustaining body as set forth in claim 3, wherein said melting point about 50° C. to about 60° C.

5. A solid, self-sustaining body as set forth in claim 1, wherein said bleaching agent is present at a level of from about 15% to about 35% by weight.

6. A solid, self-sustaining body as set forth in claim 5, wherein said bleaching agent is present at a level of from about 20%.

7. A solid, self-sustaining body as set forth in claim 1, wherein said activator is present at level from about 5% to about 15%.

8. A solid, self-sustaining body as set forth in claim 7, wherein said activator is present at level from about 7%.

9. A solid, self-sustaining body as set forth in claim 1, wherein said binding agent is present at level from about 30% to about 55%.

10. A solid, self-sustaining body as set forth in claim 9, wherein said binding agent is present at level from about 35% to about 45%.

11. A solid, self-sustaining body as set forth in claim 1, wherein is included a quantity of an essentially anhydrous anionic surfactant.

12. A solid, self-sustaining body as set forth in claim 11, wherein said surfactant is selected from the group consisting of, alkali metal alkylbenzene sulfonates, alkali metal alkylsulfates, alkali metal α-olefin sulfonates and mixtures thereof, and soaps.

13. A method of preparing a solid, essentially anhydrous bleaching, detergent and sanitizing body comprising the steps of:

melting a quantity of an essentially anhydrous, water-soluble, non-ionic surfactant binding agent that does not react with water, that has a melting point within the range of about 35° C. to about 85° C. and which is selected from the group consisting of ethylene oxide adducts of octyl-phenols, ethylene oxide adducts of nonyl-phenols ethylene oxide adducts of dodecyl-phenols, and primary and secondary alcohol ethoxylates;

introducing into the melted binding agent to produce a substantially homogeneous mixture therein of a quantity of a peroxygen bleaching agent devoid of water of hydration, a quantity of an oxygen bleach activator capable of reacting with the bleaching agent to form a per-acid with oxygen, and a quantity of a water-conditioning agent selected from the group consisting of sodium tripolyphosphate, tetrasodium pyrophosphate, trisodium nitrilotriacetate, sodium polyacrylate and zeolites, pouring the liquid admixture of said bleaching agent, activator, water-conditioning agent, and binding agent into a mold for forming said body; and allowing the admixture to cool to a self-sustaining state;

said hardened, self-sustaining body containing on a percent by weight basis from about 10% to about 45% of the bleaching agent, from about 3% to about 20% of the activator, from about 10% to about 30% of said water-conditioning agent, and from about 25% to about 65% of the binding agent said body containing less than 1% by weight water.

14. A method of preparing a solid, essentially anhydrous bleaching, detergent and sanitizing body as set forth in claim 13, wherein is included the step of incorporating an essentially anhydrous anionic surfactant in the binding agent while the latter is in a molten condition.

* * * * *